US006873821B2

(12) United States Patent
Russel et al.

(10) Patent No.: US 6,873,821 B2
(45) Date of Patent: Mar. 29, 2005

(54) THERMALLY UNIFORM SHEET TRANSPORT FOR PRINTERS

(75) Inventors: Steven M. Russel, Pittsford, NY (US); Alvin D. Kromm, Jr., Webster, NY (US); James J. Spence, Honeoye Falls, NY (US)

(73) Assignee: Xerox Corporation, Stamford, CT (US)

( * ) Notice: Subject to any disclaimer, the term of this patent is extended or adjusted under 35 U.S.C. 154(b) by 14 days.

(21) Appl. No.: 10/606,552

(22) Filed: Jun. 26, 2003

(65) Prior Publication Data

US 2004/0265025 A1 Dec. 30, 2004

(51) Int. Cl.[7] ..... G03G 15/00
(52) U.S. Cl. ..... 399/400; 399/397
(58) Field of Search ..... 399/400, 397, 399/379; 271/276, 275, 194, 196, 197; 355/76

(56) References Cited

U.S. PATENT DOCUMENTS 4,294,540 A 10/1981 Thettu ..... 355/76
4,493,548 A * 1/1985 Ateya ..... 399/400
4,618,138 A 10/1986 Silverberg ..... 271/245
4,825,255 A 4/1989 Iaia, Jr. et al. ..... 355/76
4,831,419 A 5/1989 Iaia, Jr. et al. ..... 355/76
4,889,331 A * 12/1989 Sardella ..... 271/11
5,004,221 A * 4/1991 Stark ..... 271/194
5,150,131 A * 9/1992 Le Jaoudour ..... 346/134
5,166,735 A * 11/1992 Malachowski ..... 399/68
5,520,382 A * 5/1996 Nakajima ..... 271/188
6,234,472 B1 * 5/2001 Juan ..... 271/194
6,270,075 B1 8/2001 Korhonen et al. ..... 271/276
6,565,081 B1 * 5/2003 Perez et al. ..... 271/183

* cited by examiner

*Primary Examiner*—Anthony H. Nguyen

(57) ABSTRACT

A sheet transport system with improved sheet contacting thermal uniformity for transporting thermally sensitive imaged print media sheets in a sheet path of a printer, in which multiple sheet feeding rollers are spaced along sheet feeding path, with each said sheet feeding roller having a substantially uniform diameter extending transversely fully across the sheet feeding path for uniform sheet contact, with uniform baffles between the rollers also extending transversely fully across the sheet feeding path, for uniform sheet contact, and with vacuum sheet holddown provided by airflow slots on oppose sides of each sheet feeding roller extending transversely across the sheet feeding path.

8 Claims, 2 Drawing Sheets

THERMALLY UNIFORM SHEET TRANSPORT FOR PRINTERS

Figure 1:
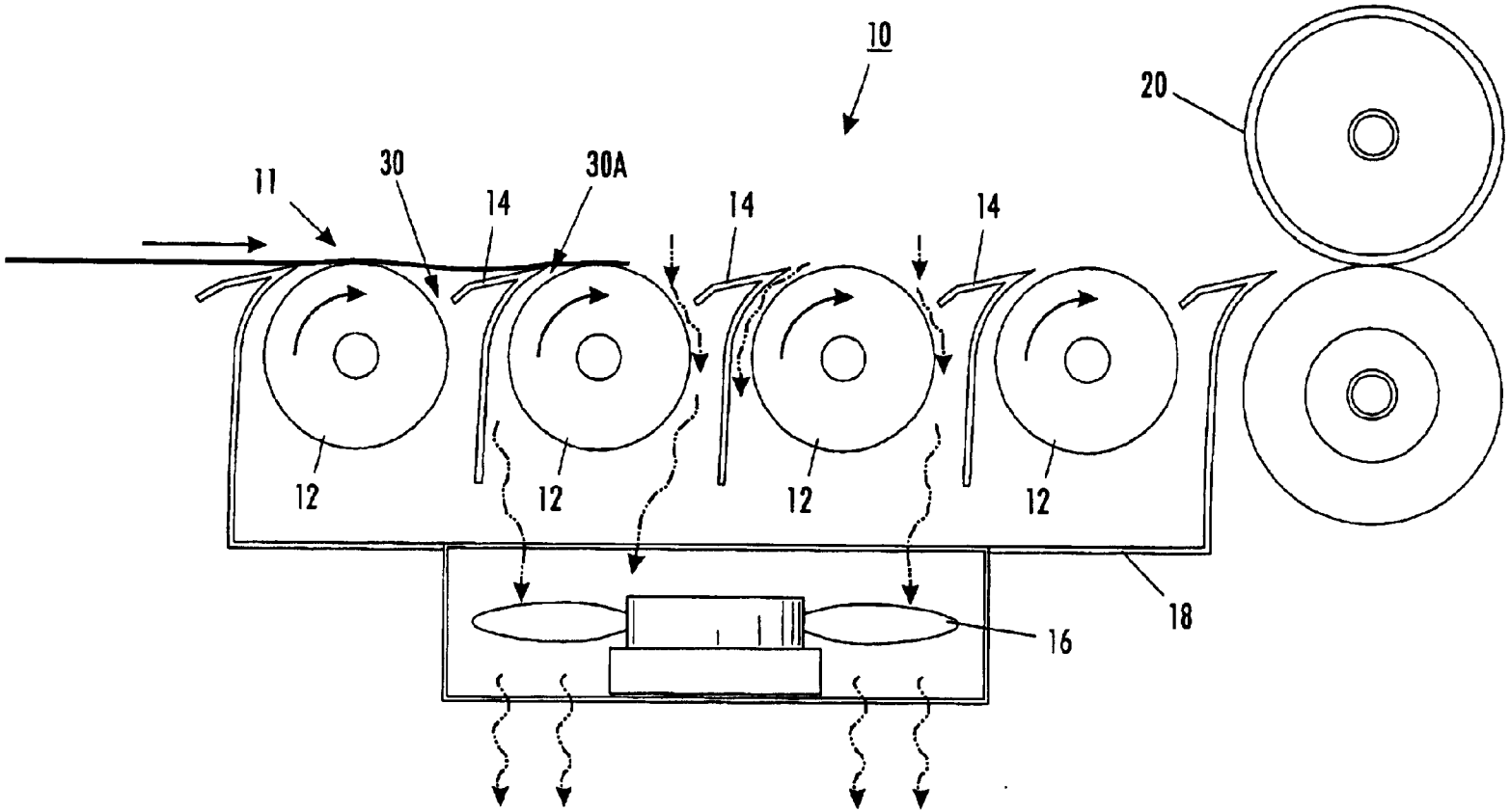

Vacuum sheet transports can be desirable for certain paper paths of various xerographic printers and other sheet transporting applications, especially in high speed printers. For example, for providing the upstream and/or downstream sheet transports of the print media sheets to and from a thermal fuser in which xerographic toner images on the print media are fused onto the printed sheets. These sheet transports are typically known vacuum belt transports with spaced and/or apertured belts. However, it has been discovered that such sheet transports, especially when heated by thermal emissions from other components of the printer, such as the fuser, can impart visible defects in areas of the printed images in some cases. Disclosed herein is a discovery of that problem and a solution. In particular, a novel combined vacuum and uniform sheet contact rollers sheet transport system which handles the sheets being transported thereon with thermal uniformity.

It will be appreciated by those skilled in the art that vacuum belt sheet transport systems, and their typical fan blower systems providing vacuums to vacuum plenums underlying the transport belt(s), are well-known and need not be described in detail herein. Some examples of vacuum belt transport systems are disclosed in Xerox Corporation U.S. Pat. No. 4,294,540 issued Oct. 13, 1981; U.S. Pat. No. 4,618,138 issued Oct. 21, 1986; U.S. Pat. No. 4,825,255 issued Apr. 25, 1989; U.S. Pat. No. 4,831,419 issued May 16, 1989; and U.S. Pat. No. 4,921,240 issued May 1, 1990.

Likewise, numerous driven balls or rollers sheet transports are known in the art. Of particular interest here is Xerox Corp. U.S. Pat. No. 6,270,075 disclosing a pre-fuser vacuum and rollers sheet transport, but with small spaced rollers, intervening ribs, and unevenly applied air flows. Sheet transports without vacuum holddown typically require overlying normal force holddown means, such as weighted or spring loaded mating idler rollers, to hold down the typical flimsy and/or curled sheets of printer print media for non-slip frictional feeding.

It has been found that high quality color fusing is very sensitive to thermal non-uniformity in the sheet prior to fuser entry. In particular, it was discovered by the present inventors that traditional elastomeric belt vacuum sheet transports can produce visible gloss differential on the fused print with as little as 20° F. (11° C.) temperature delta at the paper contact surface with the transport. Areas on the transport of lower thermal transfer (belt holes, belt edge, spaces between belts or other non-contact areas) can result in visibly lower gloss output since the sheet receives little or no thermal energy there. Areas of high thermal transfer (sheet belt contact surfaces and contacting metal baffle or manifold surfaces between the belts) can result in visibly higher gloss output since the sheet receives more thermal energy there. The end result is that a pattern of the belts and holes of the sheet transport can be noticeable on the print as differential gloss.

To express this in other words, typical vacuum transports use belts with holes through which vacuum is applied. The belt surface reaches one temperature, while the metal baffle surface or surfaces between the belts reaches another temperature, and the belt holes don't have any temperature affect at all, since they never contact the sheet. When the unfused sheet passes over the transport, the areas in contact with the hottest surfaces pick up the most heat and the areas over the belt holes pick up no heat. This subtle difference has been discovered to be able to affect the gloss of the fused copy toner image enough to be noticed by customers as image artifact defects, especially in uniform or solid image areas. The artifact is a faint superimposed image appearance of the belt hole pattern in solid image areas.

A specific feature of the specific embodiment disclosed herein is to provide a sheet transport system for transporting print media sheets in a part of a printer sheet feeding path, said sheet transport system having a plurality of sheet feeding rollers spaced apart along said sheet feeding path, each said sheet feeding roller having a substantially uniform diameter extending transversely fully across said sheet feeding path and uniformly exposed to direct contact with said print media sheets, and wherein adjacent to each of at least a plurality of said sheet feeding rollers is at least one airflow slot extending transversely across said sheet feeding path, said airflow slots pneumatically communicating with an underlying vacuum manifold to provide a vacuum force on said sheets on said sheet transport system via said airflow slots extending transversely across said sheet feeding path, said sheet transport system providing substantially uniform transverse temperature control over said print media sheets being fed by said sheet transport system.

Other specific features of the specific embodiment herein, individually or in combination, include those wherein said sheet transport system provides substantially uniform cooling or heating of said print media sheets being fed by said sheet transport system; and/or wherein said sheet transport system is positioned in said printer sheet feeding path in a heated location; and/or wherein said printer sheet feeding path includes a thermal image fuser and said sheet transport system is exposed to heat from said thermal image fuser; and/or wherein said sheet transport system further includes sheet baffles between said sheet feeding rollers extending uniformly transversely fully across said sheet feeding path, for uniform sheet contact; and/or wherein said print media sheets are held down against said sheet feeding rollers by vacuum airflows provided from said airflow slots on both sides of said sheet feeding roller, which airflow slots extend transversely across the sheet feeding path; and/or wherein said airflow slots have a substantially uniform width and extend transversely across said sheet feeding path along both sides of said sheet feeding rollers, and said airflow slots having a width smaller than said diameter of said sheet feeding rollers; and/or wherein said airflow slots on one side of said sheet feeding rollers are wider than said airflow slots on the opposite sides of said sheet feeding rollers.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed.

As to specific components of the subject apparatus or method, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuation's, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
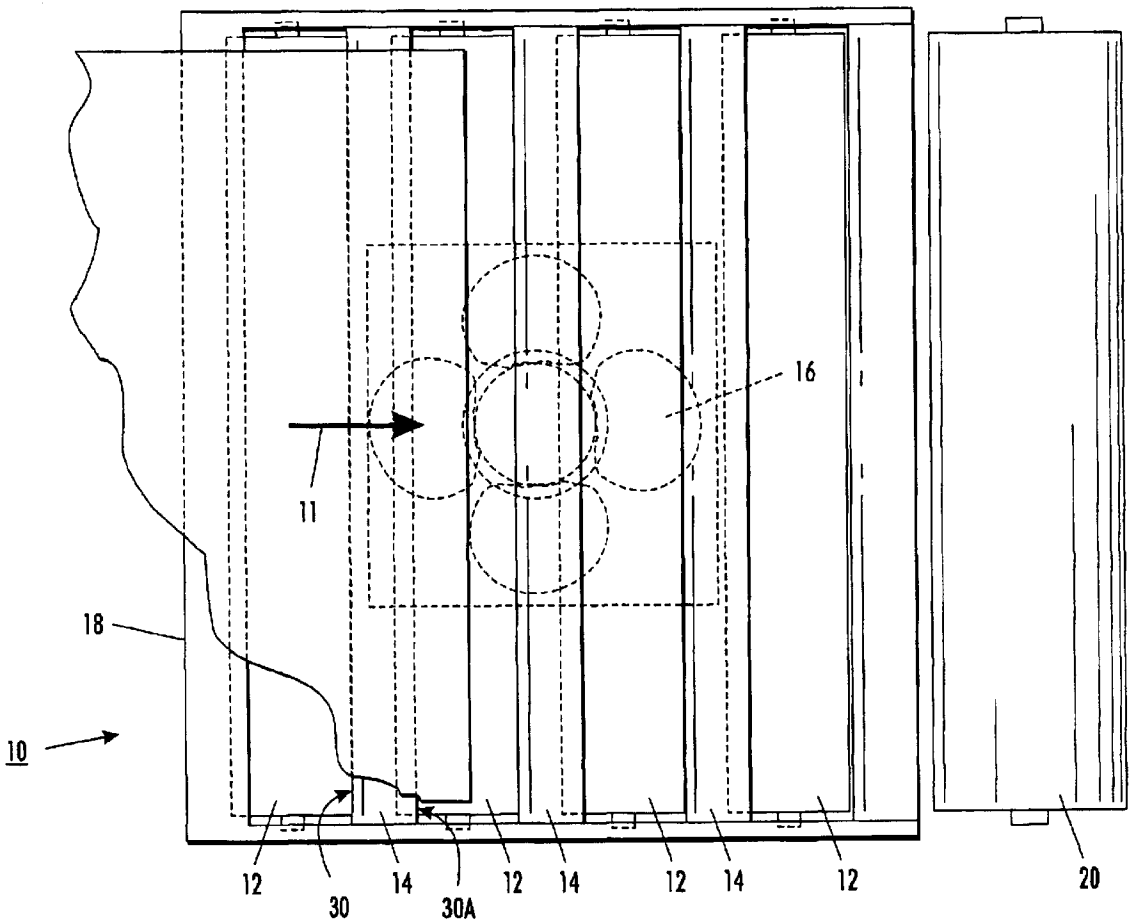

Various of the above-mentioned and further features and advantages will be apparent to those skilled in the art from the specific apparatus and its operation or methods described in the example below, and the claims. Thus, the present invention will be better understood from this description of this specific embodiment, including the drawing figures (which are approximately to scale, except that the vacuum belt sheet transport would typically be longer than as illustrated here) wherein:

FIG. 1 is a partially schematic side view of one example of an improved sheet transport system; and FIG. 2 is a partially schematic top view of the system of FIG. 1.

In this disclosed embodiment, a vacuum sheet transport system 10 forms part of an otherwise conventional xerographic printer sheet path 11 which therefore need not be described herein. In particular, a pre-fuser transport. The system 10 here includes a spaced series of high temperature elastomer foam coated elongated cylindrical sheet feed rollers 12, arranged in a plane as shown, with their axial drive shafts interconnected with a conventional gear, chain or belt drive system to be commonly rotatably driven. The spacing and size of the rolls 12 may be conventionally determined empirically for smooth paper handling transitions between rolls and for the shortest sheets to be fed through the sheet path 11. In between each roll 12 here is a metal baffle 14, tilted down at its lead edge to prevent sheet stubbing. Vacuum is applied to sheets on the sheet transport system 10 via a conventional axial fan 16 which provides high air flow at low pressure and is insensitive to leakage in the enclosure or manifold 18 under the baffles 14 and rollers 12.

Each roller 12 and baffle 14 here is full width, extending uniformly transversely across the entire paper path 11. Thus, the sheets of transported toner-bearing imaged paper thereon sees a thermally uniform profile as they are fed over the transport 10. The applied vacuum assures that the sheet is controlled and driven forward downstream, in this example, to the nip of a thermal roll fuser 20. The normal force holding the sheets down against the commonly rotatably driven transport rollers 14 providing the sheet movement is provided here via the vacuum from the vacuum blower 16 applied via the manifold 18 to elongated open regions or air slots 30 and 30A ahead of and behind each roller, as illustrated. That normal force is sufficient for effective frictional traction of the sheet by the rollers. The spacing and size of the elongated rollers 12 and the width of the air slots (gaps in the baffles 14 on each side of the rollers 12), especially the initial or upstream air slot, is also optimized to provide adequate air flow for acquisition of the sheet lead edge as it moves onto the transport 10 and reacquisition of the lead edge as it moves across the transport.

In the Figures the rollers 12 are shown rotating clockwise to move paper from left to right. Air is drawn into the underlying vacuum manifold or chamber 18 through said air slits 30 and 30A on opposite sides of the transport rollers 12. On the entry or upstream side the air slit 30 may wider, since stubbing of the lead edge of the sheet on the upwardly moving roller 12 surface is of less concern. On the exit side, the slit 30A is desirably narrower to prevent stubbing. The sheet lead edge emerges from each roller 12 tangency point into the weaker acquisition flow provided by the smaller slit, then over the baffle surface to be more forcibly re-acquired by the larger slit before reaching the next roll.

Although the baffles 14 may be at a different temperature than the rollers 12, the sheet still sees a uniform thermal condition transverse to the direction of travel. In other words, if the sheet were sliced into sections from front to rear (outboard to inboard) each section would be exposed to the same thermal conditions across the transport. Thus, artifacts produced by conventional belt transports, or multiple small rollers, due to uneven heating, cooling or insulating effects, can be eliminated.

Other advantages of the exemplary sheet transport 10 are cost and reliability, since the main wear component of belt transports has been eliminated (the belts). There are also no belt tracking concerns. The rollers 10 can be mounted on fixed axes. The torque required to drive the roller should also be lower than that of tensioned transport belts sliding over manifold surfaces.

Further improvements to the traction abilities could be had, for example, by machining spiral slots in the rolls, and allowing air flow through the slit roll surface for added vacuum hold-down force. A spiral slot roller surface pattern could still provide a uniform thermal load to the sheet, unlike straight slots.

The transport system 10 is desirable as a pre-fuser sheet transport, as shown, where uniform sheet heating is desired. However, the same or a similar sheet transport could also be used as a post-fuser transport where uniform sheet cooling is desired for also reducing image artifacts, or possibly for reducing sheet buckling tendencies.

In summary, the disclosed embodiment solves an image defect problem in printed sheets which was been discovered to be a problem of differential heating of the sheet as it is moved across the surface of a sheet transport. A problem that was discovered to be inherent in prior belt or roller transport systems With individual spaced apart belts, rollers and/or ribs which give differential heating or cooling to a sheet as it passes over their sheet-engaging surfaces. The disclosed embodiment eliminates such differential heating or cooling of the sheet by presenting a uniform thermal profile to the sheet which cannot be provided by sheet transports with small plural spaced individual rollers and ribs, or non-uniform airflows, such as the above-cited U.S. Pat. No. 6,270,075 pre-fuser vacuum sheet transport with small spaced rollers and unevenly applied air. The full width uniform engagement nature of the sheet feed rolls, and the uniformly distributed airflow, of the present embodiment (extending transversely across the entire sheet feeding path) prevents any localized temperature gradient, and thus it is believed will solve the problem of such image quality artifacts.

Further as to the discovered problems of unwanted uneven warming or cooling of the sheet by the sheet transport, this can be caused ambient air from other printer components heating the transport components, and/or the frictional heating of belts sliding over the manifold in a vacuum belt transport. For example, the air temperature around the "iGen3"™ printer prefuser transport is normally about 85° F. (29.4° C.). However, due to various heat sources near the transport, the transport surface typically runs around 95° F. (35.0° C.). But at the time the inventors discovered the printed sheets image artifacts in question, it was also discovered that air from the adjacent fuser air stripper system was elevating the sheet transport surface to as much as 115° F. (46.1° C.) or so in worse cases. They ran an experiment and plotted the artifact severity as a function of transport surface temperature to find that at surface temperatures at or above 100° F. (37.8° C.), the artifact was visible and objectionable by customers. So even after addressing the fuser heat contribution, the existing system was still near a failure threshold.

The disclosed embodiment is for a sheet transport without radiant or other added sheet heating or cooling, or positive air blowing, but it could be.

As noted he disclosed embodiment is especially useful in the pre-fuser location in preventing unwanted uneven warming of the sheet by the transport. Uneven warming of the sheet and the subsequent artifact signature in that location is well documented on "iGen3"™ printers in some situations, as discussed above. It is also anticipated that the same transport here may be used as a post fuser transport, to prevent a similar set of image artifacts that would be caused by uneven sheet cooling. The vacuum air flow can provide additional advantages of enhanced or faster cooling and moisture dissipation of the heated sheets exiting a typical xerographic thermal toner image fuser of a xerographic printer.

It will be appreciated that various presently unforeseen or unanticipated alternatives, modifications, variations or improvements therein may be subsequently made by those skilled in the art which are also intended to be encompassed by the following claims.

What is claimed is:

1. A sheet transport system for transporting print media sheets in a part of a printer sheet feeding path, said sheet transport system having at least a plurality of sheet feeding rollers spaced apart along said sheet feeding path, each said sheet feeding roller having a substantially uniform diameter extending transversely fully across said sheet feeding path and uniformly exposed to direct contact with said print media sheets in said printer sheet feeding path, wherein there is additionally provided in said sheet transport system a vacuum manifold underlying said plurality of sheet feeding rollers and at least one sheet transport baffle and airflow slot between each of said plurality of sheet feeding rollers, said airflow slots extending transversely across said sheet feeding path, said airflow slots pneumatically communicating with said underlying vacuum manifold to provide a vacuum force on said sheets in said sheet transport system adjacent said plurality of sheet feeding rollers via said airflow slots extending transversely across said sheet feeding path to hold said print media sheets against said sheet feeding rollers to provide substantially uniform transverse temperature control over said print media sheets being fed by said sheet transport system.

2. The sheet transport system of claim 1 wherein said sheet transport system provides substantially uniform cooling or heating of said print media sheets being fed by said sheet transport system.

3. The sheet transport system of claim 1 wherein said sheet transport system is positioned in said printer sheet feeding path in a heated location.

4. The sheet transport system of claim 1 wherein said printer sheet feeding path includes a thermal image fuser and said sheet transport system is exposed to heat from said thermal image fuser.

5. The sheet transport system of claim 1 wherein said sheet transport system sheet baffles between said sheet feeding rollers are extending uniformly transversely fully across said sheet feeding path, for uniform sheet control.

6. The sheet transport system of claim 1 wherein said airflow slots extend along both sides of said plural sheet feeding rollers and said print media sheets are held down against said plural sheet feeding rollers by vacuum airflows provided from said airflow slots on both sides of said plural sheet feeding rollers, which extend transversely across said sheet feeding path.

7. The sheet transport system of claim 1 wherein said airflow slots have a substantially uniform width and extend transversely across the entire said sheet feeding path along both sides of said plural sheet feeding rollers, said airflow slots said substantially uniform width being smaller than said diameter of said plural sheet feeding rollers.

8. The sheet transport system of claim 6 wherein said airflow slots on one side of said plural sheet feeding rollers are wider than said airflow slots on the opposite sides of said sheet feeding rollers.

* * * * *